United States Patent [19]

Welch

[11] 4,258,594

[45] Mar. 31, 1981

[54] SOCKET WRENCH WITH AUXILIARY DRIVE

[75] Inventor: Herbert E. Welch, Manchester, Ga.

[73] Assignee: Frederick A. Shenton, Warms Springs, Ga.

[21] Appl. No.: 51,907

[22] Filed: Jun. 25, 1979

[51] Int. Cl.[3] ..... B25B 17/00

[52] U.S. Cl. ..... 81/57.29; 81/58.1

[58] Field of Search ..... 81/57.29, 58.1, 58.3

[56] References Cited

U.S. PATENT DOCUMENTS

| | | | |
|---|---|---|---|
| 1,772,524 | 8/1930 | Seidemann | 81/58.3 |
| 2,641,291 | 6/1953 | Yess | 81/58.3 |
| 2,707,893 | 5/1955 | Bohnet | 81/58.3 |
| 3,099,177 | 7/1963 | Kostka | 81/58.1 |
| 3,827,470 | 8/1974 | Douglas et al. | 81/58.3 |
| 4,128,025 | 12/1978 | Main et al. | 81/58.1 |

*Primary Examiner*—James L. Jones, Jr.
*Attorney, Agent, or Firm*—Clifton T. Hunt

[57] ABSTRACT

A socket wrench having the usual handle and squared stud on which a selected wrench socket may be fitted in the usual manner and provided with a gear train extending from the stud to the handle and has a drive wheel extending circumferentially about the handle and keyed to the gear train to permit relative rotation of the drive wheel and socket. Means are provided for releasably locking the thumb wheel against rotation relative to the handle to permit torque to be applied to the nut being tightened or loosened. Resilient means normally urge the drive wheel out of locking engagement where it may be easily rotated by the thumb of the operator to impart corresponding rotation to the nut to tighten or loosen it with minimum pressure.

5 Claims, 5 Drawing Figures

SOCKET WRENCH WITH AUXILIARY DRIVE

BACKGROUND OF THE INVENTION

Ratchet wrenches have been provided which permit free rotation of the stud in a selected direction but lock the stud against rotation in the opposite direction to tighten or loosen a nut threaded on a bolt or the like. This type of ratchet wrench requires that the entire handle be rotated with the stud to effect corresponding movement of the stud and its associated socket and workpiece such as a bolt or nut. Movement of the entire handle is sometimes limited to only a small arc because the handle hits obstacles such as parts of an engine.

Wrenches have been provided with auxiliary drive means whereby the stud and its associated socket may be rotated without corresponding movement of the handle. One such auxiliary drive means is illustrated in U.S. Pat. No. 1,786,701 issued Dec. 30, 1930 to Hilton B. Butlin. Butlin discloses a wrench having a hollow handle with a shaft extending through the handle and joined at one end to a beveled gear wheel meshing with a second beveled gear wheel mounted on an angularly disposed shaft having a stud fixed at its outer end to receive a desired socket. A wheel is fixed to the other end of the shaft extending through the handle remote from the gears, and the stud may be rotated by rotation of the wheel imparting corresponding rotation to the shaft, gears and stud. The wheel may be locked against movement relative to the handle when necessary to use the handle for leverage to tighten or loosen a nut. It clearly takes two hands to operate the Butlin wrench.

U.S. Pat. No. 2,603,976 issued July 22, 1952 to John H. Hilton discloses an attachment for rotating a loosened nut on a threaded bolt without moving the handle of the wrench. Hilton provides a sleeve externally of the handle and the sleeve is geared to rotate a shaft extending axially through the handle with a worm gear engaged with a spur gear to rotate the socket retaining stud. Rotation of the sleeve is effective to rotate a loosened nut to remove it from its bolt or to move it in position to be tightened on the bolt. Hilton employs a ratchet mechanism to selectively permit rotation of the sleeve in one direction relative to the handle while fixing the sleeve against rotation in the opposite direction relative to the handle when desired to apply leverage to a nut. Two hands are required to set the ratchet and the gear arrangement of Hilton and results in undesirably slow rotation of the stud and its associated nut when rotated by the sleeve, it requiring about three revolutions of the sleeve to rotate the stud a single revolution.

U.S. Pat. No. 3,283,621 issued Nov. 8, 1966 to William J. Faso, U.S. Pat. No. 3,463,038 issued Aug. 26, 1969 to Louis C. Scull, U.S. Pat. No. 2,756,792 issued July 31, 1956 to Jerold Hirschman, and U.S. Pat. No. 1,733,288 issued Oct. 29, 1929 to Clary M. Tune are other examples of the prior art known to applicant, but none of them disclose the novel apparatus claimed by applicant to speedily rotate a nut loosely threaded on a shaft or bolt and requiring only one hand to manipulate the speed accessory and/or the handle of the wrench as desired for leverage.

SUMMARY OF THE INVENTION

According to the invention, a socket wrench having a handle and a socket receiving stud extending in angular relation to the handle is provided with a thumb actuated drive wheel which may be selectively manipulated by the thumb of an operator's hand holding the wrench to rotate the drive wheel and impart corresponding rotation to the stud, or the drive wheel may be moved axially along the handle to engage an irregular end surface of the drive wheel with a correspondingly shaped portion of the handle to lock the drive wheel against rotation relative to the handle when desired to apply leverage to the socket receiving stud to move a tightened nut.

It is an object of this invention to provide a wrench with a nut moving accessory of the type described wherein resilient means are provided for normally urging the drive wheel out of locking engagement with the handle.

It is a further object of this invention to provide a device of the type described wherein the drive wheel is keyed to a drive shaft extending axially through the handle, said drive wheel being connected to a gear train at one end of the handle and terminating in a squared configuration at the other end of the handle remote from the socket receiving stud.

It is another object of this invention to provide a device of the type described wherein a wrench may be applied to the free squared end of the drive shaft to rotate the socket receiving stud as desired.

DETAILED DESCRIPTION OF THE INVENTION

Figures 1, 2, 3, 4, 5:
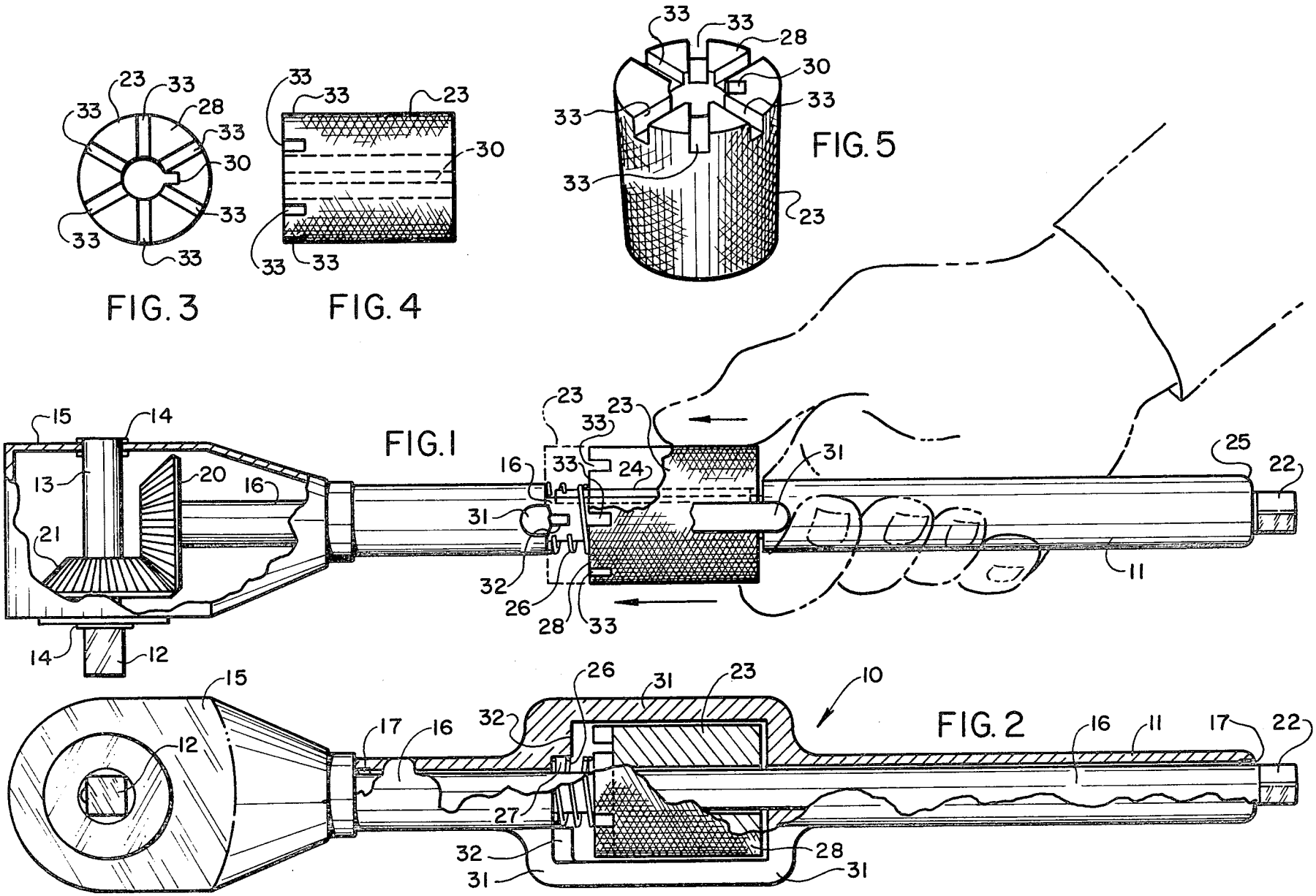
FIG. 1 is a side elevation of the wrench with parts broken away illustrating the drive wheel in its solid line operative position and in its phantom line inoperative position.
FIG. 2 is a view similar to FIG. 1 but rotated 90 degrees and with parts broken away.
FIG. 3 is an end view looking at the irregular forward surface of the drive wheel removed from the wrench.
FIG. 4 is a side view of the drive wheel removed from the wrench.
FIG. 5 is a perspective view looking at the forward end of the drive wheel.

Referring more specifically to the drawings, the numeral 10 broadly designates a wrench of the socket type having a handle 11 and a stud 12 mounted for rotation relative to the handle 11 and extending in perpendicular relation therefrom. The stud 12 is adapted to receive a socket which is in turn engaged with a correspondingly sized nut threaded on a bolt (not shown), all of which is conventional.

Socket wrenches with ratchet mechanisms are commonly used today. The ratchet may be adjusted to permit the handle of the wrench to apply force to the nut after it is hand tightened. The handle may be moved in the opposite direction while the socket and the nut remain stationary because of the ratchet mechanism. The advantage of the ratchet mechanism on the socket wrench is that it is not necessary to replace the socket on the nut after every turn of the wrench. It is necessary to move the handle of the wrench in order to impart any rotation to the nut engaged by the socket in the type of socket wrench thus far described. The requirement that the handle be moved to rotate the nut is disadvantageous in certain instances where the nut is in a cramped space and movement of the handle is limited, as by the parts of an engine.

It is known in the prior art to provide in a socket wrench means for rotating the nut independently of movement of the handle. Such means are disclosed in the foregoing discussion of the Background of the Invention. Two hands are required to conveniently manipulate the auxiliary drive in the prior art and some prior art mechanisms retain ratchet devices which require adjustment and also unnecessarily increase the cost of the wrench.

According to the present invention a ratchet effect is obtained without the cost of conventional ratchet parts, and the wrench of this invention may be held in one hand and a drive wheel rotated by that same hand to turn a nut relative to the handle of the wrench. Alternatively the drive wheel may be released and permitted to rotate on its axis as the handle 11 is rotated relative to a tightened nut back to its starting position.

The stud 12 forms one terminus of a work shaft 13 journaled as at 14 in a gear housing 15 extending from one end of the handle 11. The handle 11 is hollow and a drive shaft 16 is journaled as at 17 within the handle 11 for rotation relative thereto. The drive shaft 16 extends beyond both ends of the handle 11 with one end of the drive shaft 16 extending into the gear housing 15. A bevel gear 20 is connected to the said one end of drive shaft 16, the gear 20 meshing with a second bevel gear 21 fixed on the work shaft 13 within gear housing 15. The other or second end of drive shaft 16 extends beyond the second end of handle 11 and terminates in a square configuration indicated at 22 adapted to receive a wrench if desired for rotating the shaft 16 and imparting corresponding rotation to the stud 12 through the gears 20, 21. It is anticipated that a wrench will be applied to the squared end 22 of the drive shaft 16 only in instances where it is desired to apply leverage to the stud 12 without corresponding movement of the handle 11.

It is intended for the drive shaft 16 to be rotated independently of the handle 11 by a drive wheel 23 keyed as at 24 on the shaft 16. As illustrated in FIG. 1, the drive wheel 23 is sufficiently spaced from the free end 25 of the handle 11 to permit an operator's hand to grasp the handle 11 between the free end 25 and the drive wheel 23, positioning the operator's thumb to manipulate the drive wheel 23.

The drive wheel 23 is normally urged into operative position to rotate the shaft 16 relative to the handle 11 by a spring 26 extending around the shaft 16 and the key 24 and bearing against the inner wall of a recess 27 (FIG. 2) and against the forward surface 28 of the drive wheel 23 to normally urge the drive wheel 23 rearwardly toward the free end 25 of handle 11 as shown in FIG. 2 and in the solid line position of FIG. 1. The drive wheel 23 in slidable axially of handle 11 by overcoming the spring 26 to move the drive wheel 23 to the forward dotted line position of FIG. 1.

Formed integral with the handle 11 and rising therefrom about the drive wheel 23 is a skeleton bridge 31 projecting from opposite surfaces of the handle 11 and bridging the drive wheel 23 to join the free end portion of the handle 11 to the forward portion of the handle 11. Diametrically opposed abutments 32 are formed integral with the bridge 31 and are of reduced thickness to mate with correspondingly shaped slots 33 cut in the forward face 28 of the drive wheel 23. Six slots 33 are illustrated in the drawings, any two diametrically opposed slots being simultaneously registrable with the diametrically opposed abutments 32 to hold the drive wheel 23 against rotation relative to the handle 11 when the drive wheel is moved axially in the direction of the arrow in FIG. 1 to overcome spring 26 and seat the abutments 32 in opposed slots 33 and lock the drive wheel against rotation relative to the handle.

In operation a socket is placed on the stud 12 and positioned on a nut which has been engaged by hand with the threads on a bolt. The drive wheel 23 is then rotated by the operator's thumb relative to the handle 11 to impart corresponding rotation to the stud 12, socket and the nut being tightened. Rotation of the drive wheel continues until the nut is fully seated on the bolt and it is necessary to apply more torque to tighten it. At that point the drive wheel 23 is slid axially along the drive shaft 16 to engage the slots 33 with the abutments 32 as the spring 26 is overcome. The drive wheel is held in the forward position by the operator's thumb while the same hand of the operator rotates the handle 11 to apply torque to the nut to achieve a desired tightness.

When it is desired to loosen the nut, the process is reversed and the drive wheel is moved to the dotted line position in FIG. 1 preparatory to applying torque to the handle and stud to loosen the nut. After the nut is loosened the drive wheel is retracted to the solid line position of FIG. 1 and the operator's thumb rotates the drive wheel to rotate the nut and remove it from the bolt.

The drive wheel may function in the manner of a ratchet by leaving it in the solid line position of FIG. 1 and removing the operator's thumb as the handle is swung back to the starting position preparatory to applying torque to the nut. When the handle is to be swung into torque applying position the drive wheel is moved forward and engaged with the abutments 32 to lock the drive wheel against rotation relative to the handle 11.

Although specific terms have been used in the specification, they are used in a descriptive sense only and not for purposes of limitation.

I claim :

1. A socket wrench having a tubular handle, an angularly disposed stud and means for rotating the stud relative to the handle, said means including a drive wheel operatively connected to the stud and journaled for rotations relative to the handle by the thumb of an operator's hand grasping the wrench, means for selectively locking the drive wheel against rotation relative to the handle, and said last-named means comprising means mounting the drive wheel for limited axial movement along the handle, an irregular surface on one end of the drive wheel and a correspondingly shaped surface on a proximal portion of the handle, whereby the drive wheel may be selectively moved into and out of locking engagement with the handle.

2. A socket wrench according to claim 1, wherein means are provided for normally urging the drive wheel away from said proximal portion of the handle and into operative stud rotating position.

3. A socket wrench having a tubular handle, an angularly disposed stud and means for rotating the stud relative to the handle, and said means including a drive wheel operatively connected to the stud and journaled for rotation relative to the handle by the thumb of an operator's hand grasping the wrench, said means for rotating the stud relative to the handle also comprising a gear train between the stud and the drive wheel, a drive shaft extending from the gear train and journaled in the handle, a key carried by the drive shaft, and said drive wheel having a keyway registering with the key, whereby rotation of the drive wheel imparts corresponding rotation to the stud relative to the handle.

4. A socket wrench according to claim 3 wherein said drive shaft includes a squared end portion projecting beyond the handle and engagable with a wrench whereby the stud may be rotated relative to the handle.

5. A socket wrench according to claim 3 which includes a skeleton bridge formed integral with the handle and overlying the drive wheel.

* * * * *